US010662771B2

(12) United States Patent
Morrison

(10) Patent No.: US 10,662,771 B2
(45) **Date of Patent: *May 26, 2020**

(54) DRILL AND BLAST METHOD AND APPARATUS FOR THE SAME

(71) Applicant: CENTRE FOR EXCELLENCE IN MINING INNOVATION, Sudbury, Ontario (CA)

(72) Inventor: Douglas Morrison, Etobicoke (CA)

(73) Assignee: CENTRE FOR EXCELLENCE IN MINING INNOVATION, Sudbury (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/040,399

(22) Filed: Jul. 19, 2018

(65) Prior Publication Data

US 2019/0017379 A1 Jan. 17, 2019

Related U.S. Application Data

(63) Continuation of application No. 14/432,169, filed as application No. PCT/CA2013/000818 on Sep. 27, 2013, now Pat. No. 10,053,984.

(60) Provisional application No. 61/706,316, filed on Sep. 27, 2012.

(51) Int. Cl.

| | |
|---|---|
| ***E21C 41/16*** | (2006.01) |
| ***E21D 19/04*** | (2006.01) |
| ***E21C 37/00*** | (2006.01) |
| ***E21C 37/14*** | (2006.01) |

(52) U.S. Cl.

CPC ..... *E21C 37/00* (2013.01); *E21C 37/14* (2013.01); *E21C 41/16* (2013.01); *E21D 19/04* (2013.01)

(58) Field of Classification Search

CPC ..... E21D 17/00; E21D 17/06; E21D 17/08; E21D 19/00; E21D 9/04; E21C 41/16

See application file for complete search history.

(56) References Cited

U.S. PATENT DOCUMENTS

| | | | |
|---|---|---|---|
| 1,932,279 | A | 10/1933 | Lauder |
| 3,115,754 | A | 12/1963 | Joseph |
| 3,266,845 | A | 8/1966 | Williamson et al. |
| 3,280,572 | A | 10/1966 | Hatton |
| 3,623,771 | A | 11/1971 | Sosnowicz et al. |

(Continued)

FOREIGN PATENT DOCUMENTS

| | | | |
|---|---|---|---|
| DE | 10393535 | T5 | 10/2005 |
| GB | 1439546 | A | 6/1976 |

(Continued)

OTHER PUBLICATIONS

U.S. Appl. No. 14/432,169, Final Office Action dated Sep. 27, 2017.

(Continued)

*Primary Examiner* — David J Bagnell
*Assistant Examiner* — Michael A Goodwin
(74) *Attorney, Agent, or Firm* — Alston & Bird LLP

(57) ABSTRACT

Disclosed is a drill and blast method for advancing the tunnel face in a mine, which makes use of a mobile canopy. The mobile canopy having vertical supports connected to a frame that supports a shield. The mobile canopy allows for face production activities and ground support activities to occur simultaneously or near simultaneously. This allows for more rapid advancement of the tunnel face compared to traditional batch drill and blast techniques.

10 Claims, 3 Drawing Sheets

(56) References Cited

U.S. PATENT DOCUMENTS

| | | | |
|---|---|---|---|
| 3,863,793 | A | 2/1975 | Fujimori |
| 3,902,324 | A | 9/1975 | Barrett |
| 3,922,866 | A | 12/1975 | Benning |
| 3,964,265 | A | 6/1976 | Jamison |
| 4,003,208 | A | 1/1977 | Hornung et al. |
| 4,360,235 | A | 11/1982 | Mendola |
| 4,395,163 | A | 7/1983 | Perraud |
| 4,710,064 | A | 12/1987 | Stafford et al. |
| 10,053,984 | B2 | 8/2018 | Morrison |
| 2011/0044770 | A1 | 2/2011 | Potvin et al. |

FOREIGN PATENT DOCUMENTS

| | | | |
|---|---|---|---|
| GB | 1576269 | A | 10/1980 |
| WO | WO 09/076710 | | 6/2009 |
| WO | WO 14/047721 | A1 | 4/2014 |

OTHER PUBLICATIONS

U.S. Appl. No. 14/432,169, Final Office Action dated Oct. 18, 2016.
U.S. Appl. No. 14/432,169, Non-Final Office Action dated Jan. 5, 2016.
U.S. Appl. No. 14/432,169, Non-Final Office Action dated May 31, 2017.
U.S. Appl. No. 14/432,169, Notice of Allowance dated Apr. 19, 2018.
WIPO Application No. PCT/CA2013/000818, PCT International Preliminary Report on Patentability dated Mar. 31, 2015.
WIPO Application No. PCT/CA2013/000818, PCT International Search Report and Written Opinion of the International Searching Authority dated Jan. 3, 2014.

DRILL AND BLAST METHOD AND APPARATUS FOR THE SAME

CROSS-REFERENCE TO RELATED APPLICATIONS

The present application is a continuation of U.S. application Ser. No. 14/432,169 filed Mar. 27, 2015, which is a national phase of PCT/CA2013/000818 filed Sep. 27, 2013, incorporated by reference in its entirety for all purposes, which claims priority to U.S. provisional application No. 61/706,316 filed Sep. 27, 2012.

FIELD OF THE INVENTION

The present invention is related to the field of mining. More specifically, the invention relates to an improvement to the batch drill and blast technique and an apparatus for use in the process.

BACKGROUND OF THE INVENTION

Current drill and blast advance rates are now at historic lows with only 4 m/day advancement possible with the most efficient and powerful equipment the mining industry has ever used. As little as 25 years ago, advance rates of 12 m/day or more were commonplace. Today, the safest and most efficient tunnel-advance technique is the tunnel-boring machine and is being developed for application to very large regular shaped ore-bodies, such as copper porphyries. Most underground base metal mines are too small and too irregular in shape to make use of this kind of technology.

The batch drill-and-blast technique has definite advantages in highly stressed grounds where seismic activity is prevalent. Blasting can be use to proactively initiate the seismic release of energy and the combination of pinned mesh coverage allows for surface expansion before rigid shotcrete support is added for long term stability.

The batch drill-and-blast process can be broken into three stages; removal of broken rock from the heading, face-advance activities, which include drilling holes and loading explosives, and ground support (i.e. roof and wall support) installation. Currently, the process of installing ground support is the most-time consuming component of the cycle and given the challenging safety and stability conditions encountered in deep mining, the quality of the final installation of this component cannot be compromised. In fact, in some cases protection from instabilities at the face may also have to be provided.

Two important characteristics of the tunnel-boring technique are (1) the reduction of exposure of the operating personnel from the danger of rock-related injuries in the heading, and (2) the simultaneous application of face-advance and ground support activities. Just as personnel are protected inside the tunnel boring machine, so must the batch drill-and-blast personnel be protected from exposure to rock-related risks at all times. To be more productive any new batch drill-and-blast process must emulate the simultaneous implementation of face-advance and ground support activities to increase the rate of advance.

SUMMARY OF THE INVENTION

According to an aspect of the present invention, there is provided a method for advancing a tunnel face in an underground mine. The method comprising the steps of: blasting the drift face with a plurality of explosives; removing debris formed by the blasting step from the heading; positioning a mobile canopy at or near the heading; drilling holes in the tunnel face and packing the same with explosives; and securing the rock structure inside and/or outside the mobile canopy.

In one embodiment, the drilling and securing steps occur simultaneously.

In another embodiment, the securing step comprises attaching mesh coverage to the walls and roof of the drift or tunnel.

In a further embodiment, the mobile canopy comprises at least a first covered structure and a second covered structure. Preferably, the mobile canopy comprises three covered structures.

According to another aspect of the present invention, there is provided a mobile canopy for use in a mining process. The mobile canopy comprising at least a first covered structure and a second covered structure. In one embodiment, the mobile canopy is provided with three covered structures. The covered structures each comprise a plurality of vertical supports connected to a frame that supports a shield.

In another embodiment, one or more of the plurality of vertical supports are adjustable to lengthen the support.

In a further embodiment, the one or more of the plurality of vertical supports are provided with hydraulics to adjust the length of the support.

In a still further embodiment, wheels are provided on one or more of the vertical supports to allow the mobile canopy to move within the drift. Alternatively, the one or more of the vertical supports engage rails provided within the drift, to move the mobile canopy.

In another embodiment, the frame is arced away from the vertical supports.

In a further embodiment, the shield comprises mesh coverage on some of the covered structures Other covered structures can have longitudinal supports interconnecting adjacent cross-members in the frame.

In a yet further embodiment, the mesh coverage is removably attached to the covered structures.

In a still further embodiment, at least two covered structures are linked.

In another embodiment, the covered structures further comprises one or more wall shieldings to shield against rock displacements from the walls and face of the tunnel. The wall shielding of one of the covered structures can comprise longitudinal supports that interconnect adjacent vertical supports and the wall shielding of the other covered structures can comprise mesh coverage.

BRIEF DESCRIPTION OF THE DRAWINGS

These and other features, aspects and advantages of the present invention will become better understood with regard to the following description and accompanying drawings wherein.

DESCRIPTION OF THE INVENTION

The following description is of a preferred embodiment by way of example only and without limitation to the combination of features necessary for carrying the invention into effect.

Batch drill-and-blast mining involves essentially three activities, which can be broadly categorized as: 1) removal of broken rock from the heading; 2) face production; and 3) ground support.

For the purposes of this disclosure, the following terms will be used to refer to the various parts of the mine. The horizontal mining tunnel in which work is taking place and where workers are present will be referred to as the drift. The tunnel face is the part of the mine where advancement of mining tunnel or drift takes place. Typically this will consist of the vertical rock surface at the end of the drift. The heading of the drift is that portion of the mine near the tunnel face, which contains the broken rock following a blast. The heading comprises the roof, walls and ground surfaces of the drift.

Removal of broken rock from the heading occurs after the explosives embedded in the tunnel face have been detonated. This step is referred to as mucking. Various machines have been developed to remove the broken rock and debris from the heading. Examples of such machines include, but are not limited to, those produced by Atlas Copco, Eimco, and Häggloader.

Figure 1:
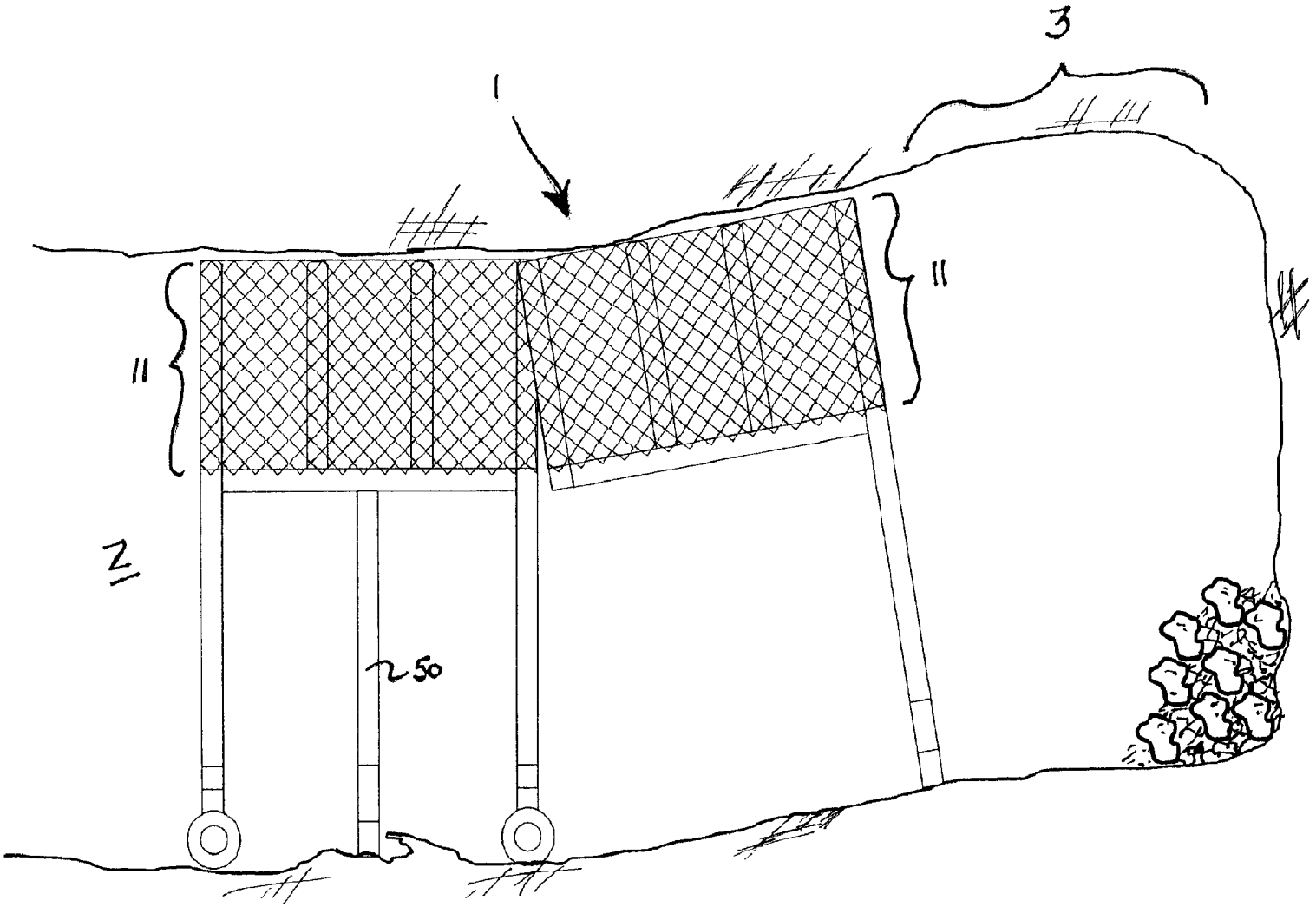
FIG. 1 shows a mobile canopy according to an embodiment of the present invention positioned in a drift.

Once the broken rock has been cleared from the heading, and the heading surveyed for potential unstable rock formations, a mobile canopy (1) can be brought into position in the drift (2) at or near the heading (3) (FIG. 1). The mobile canopy (1) will provide shelter for the workers underneath, so that face production and ground support activities can take place simultaneously or nearly simultaneously.

Face production activities include drilling or boring holes in the tunnel face and packing the same with explosives. In some cases, the face production activities might also include forms of sampling to determine one or more characteristics of the rock structure.

In the present batch drill-and-blast technique, the protection provided by the mobile canopy allows for ground supporting activities to take place at the same time as the face production crew is at work. Ground support activities typically involve applying shielding to the roof and wall surfaces of the drift to protect against random rock falls or rock bursts. The shielding can be in the form of mesh coverage, which is standard in the industry. The shielding is attached to the roof and wall surfaces of the drift using standard techniques, such as rock bolting or doweling.

The ground support activities take place behind the mobile canopy, or in some embodiments, can involve part of the mobile canopy. Having the mobile canopy positioned at or near the heading allows for face production work to proceed before the ground support activities have been completed. Traditionally, the heading would have to be secured before the face production crew could enter and begin work. In the present invention, the mobile canopy provides protection to the face production crew while the ground support crew performs its activities. This arrangement allows for more rapid turnaround between blasts.

Figure 2:
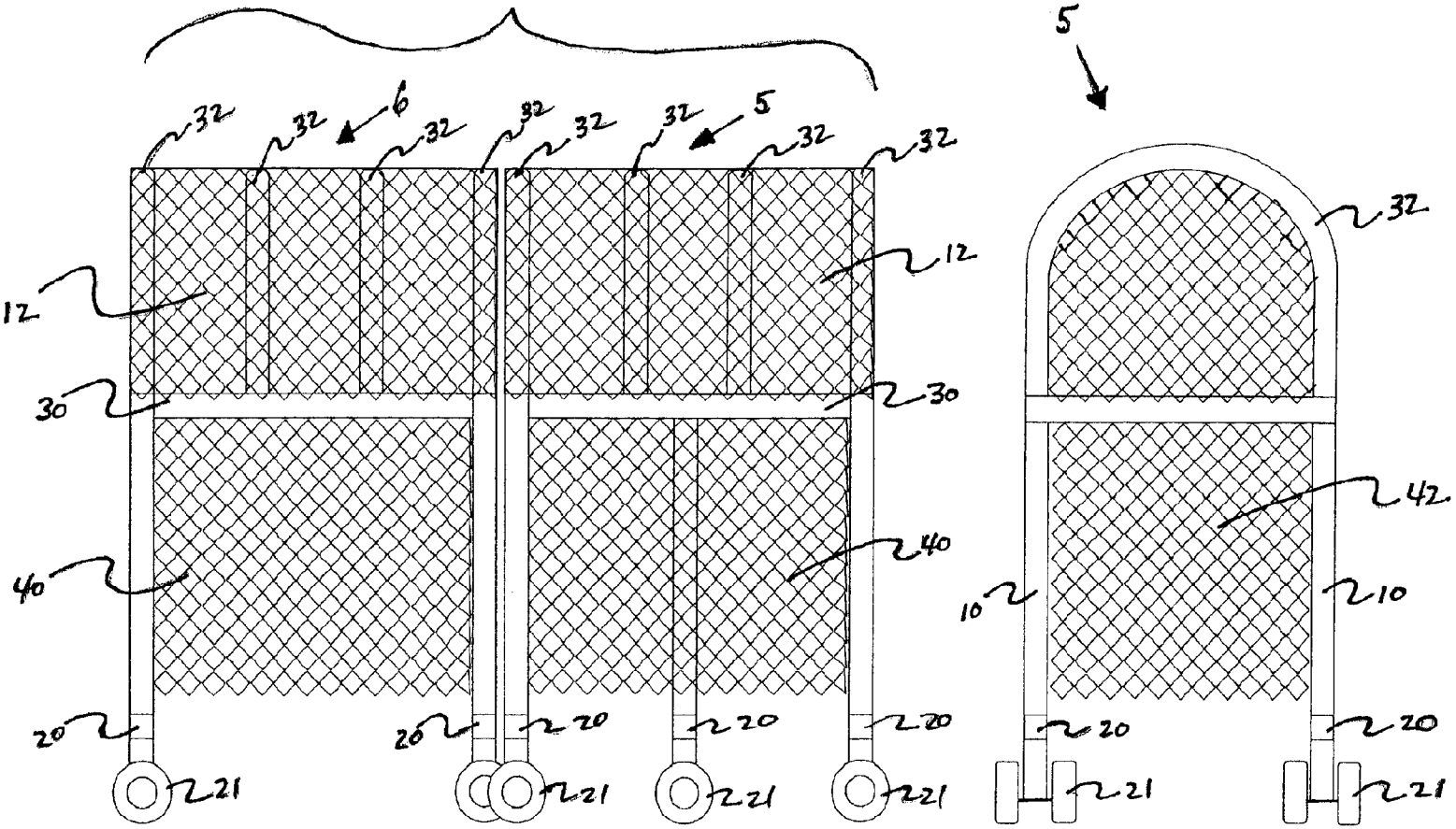
FIG. 2 shows a mobile canopy according to an embodiment of the present invention.

As shown in FIG. 2, the mobile canopy (1) of the present invention includes a covered structure comprising a plurality of vertical supports (10) connected to a frame (11) that supports a shield (12). In one embodiment, the mobile canopy (1) comprises at least two covered structures (5, 6), each covered structure comprising a plurality of vertical supports (10) connected to a frame (11) that supports a shield (12). In the embodiment shown in FIG. 3, three covered structures (5, 6, 61) are provided, each structure connected to its neighbour by interconnected rings (60).

The vertical supports (10) are provided to support the frame (11) and position it near the roof of the drift. Since the main purpose of the mobile canopy (1) is to protect workers and machines positioned underneath the canopy from falling rock, the vertical supports (10) should be made from a material that is strong enough to support such an impact. As such, steel is a preferred material for the supports. In one embodiment, the vertical supports (10) are capable of being lengthened so that the height of the mobile canopy (1) can be adjusted to accommodate irregularities in the height of the drift. For example, hydraulic or screw jacks or pneumatic cylinders (20) can be provided within the vertical supports (10) or attached thereto to allow for adjustment of the length of the supports (10).

The vertical supports (10) of the mobile canopy (1) can also be connected to wheels (21) to allow movement of the canopy (1) within the drift. Alternatively, the vertical supports (10) may engage rails provided in the drift to permit movement of the canopy (1). For example, the engagement of the vertical supports (10) and the rails may occur through the wheels provided on the supports.

Lateral movement of the covered structures (5, 6, 61) can be limited by including lateral supports (62) on the vertical supports (10) or the frame (11). Similar to the vertical supports (10), the lateral supports (62) are capable of being lengthened to accommodate irregularities in the width of the drift (2).

In most cases, a vertical support (10) will be positioned at each corner of the frame to provide adequate support to the covered structure. However, additional support may be achieved by positioning a leg (50) along each longitudinal side of the frame central to the two vertical supports (10). Depending on the overall length of the longitudinal sides of the frame (11), a plurality of legs (50) may be provided interspaced between the two corner vertical supports (10). In the embodiment shown in FIG. 1, vertical supports (10) are provided on two of the four corners of one of the covered structures, and the back portion of the covered structure is supported by the vertical supports (10) of the second covered structure.

Figure 3:
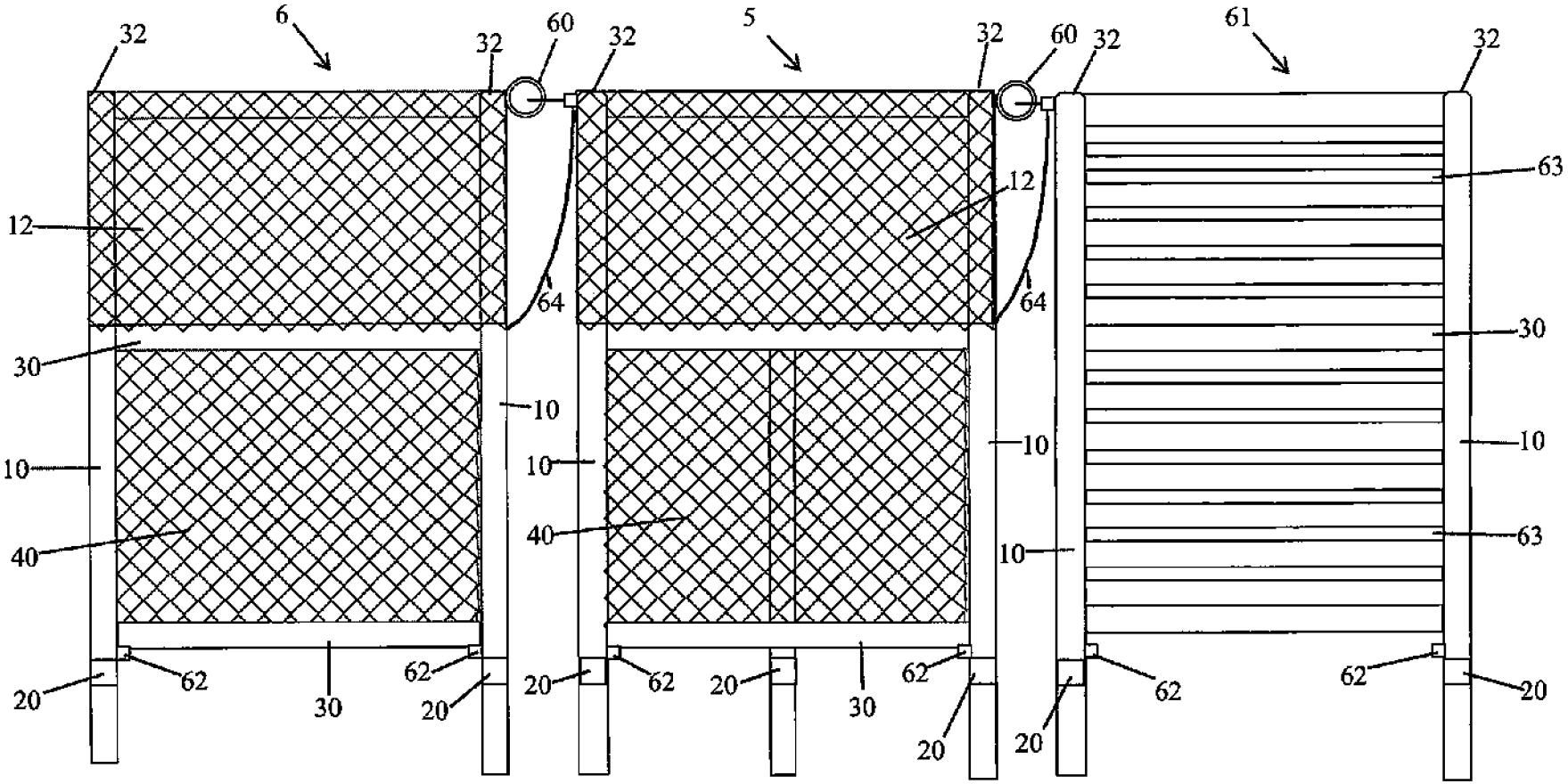
FIG. 3 shows a mobile canopy according to an embodiment of the present invention

The vertical supports (10) are connected to a frame (11), which supports a shield (12). The frame consists of two longitudinal sides (30) and may be interconnected by at least cross members (32) positioned on or near either end of the longitudinal sides (30). The overall strength and support of the canopy (1) can be improved by providing additional cross members (32) between the two end cross member (32) sections. In addition, longitudinal supports (63) can be provided to connect adjacent cross members (32) (FIG. 3). In one embodiment, the cross members (32) are arced to allow for rocks to roll off the shield (12) in the event a rock comes into contact with the shield (12). The various elements of the frame (11) are also preferably made from steel.

In one preferred embodiment, a shield (12) overlays the frame (11). However, the shield (12) can also be hung from the frame (11). The shield (12) is preferably made from mesh coverage, which is typically used in the mining industry to support the roof and walls of the drift (2). Examples, of such shielding material includes, but is not limited to, typically 4 inch welded wire mesh #6 or #4 gauge or chain link mesh of similar gauge. Alternatively, as shown in the covered structure (61) of FIG. 3, the shield (12) can comprise a plurality of longitudinal supports (63) in order to provide a more permanent form of protection and support.

In order to provide added protection to the workers positioned under the mobile canopy (1), wall shielding (40) may be also provided on the longitudinal sides of the covered structures (5,6). In this case, the wall shielding (40) may be extended from the longitudinal sides (30) of the frame (11) to or near the floor of the drift (2) or may be extended to a height between the floor of the drift (2) and the frame (11). The wall shielding (40) can be made of a similar material as provided for the shield (12), i.e. mesh coverage or longitudinal supports (63), or a combination of materials may be used depending on the situation. In addition to the wall shielding (40), or separate therefrom, front facing shielding (42) may be provided from one of the end cross members (32) on the frame (11). The front facing shielding (42) prevents or limits the possibility of injury from rock displacements that occur at the tunnel face. The front facing shielding (42) can be provided from the same material as used for the shield (12) or may be a chain mesh that is hung from the end cross member (32) of the frame (11).

In one arrangement, the mobile canopy (1) comprises at least two covered structures (5,6). In another, preferred arrangement, the mobile canopy (1) includes three independent covered structures (5, 6, 61) (FIG. 3). The covered structures (5,6,61) can be connected to allow each structure (5,6,61) to travel freely in the drift (2). Alternatively, the two structures (5,6) can be permanently connected, but hinged to allow each structure (5,6) to move independently from each other. For example, the structures (5,6) can be both permanently and releasably connected by interconnected rings (60), which are attached to the frame (11) of each structure (5,6,61).

When the mobile canopy (1) comprises at least two covered structures (5,6,61), the structure (5 or 61) closest to the face can be provided with front facing shielding (42) described above. In this case, it may not be necessary to provide such shielding on the second structure (6 or 5), since injury resulting from rock displacements on the face will be less of a concern. However, curtains (64) can be provided between the covered structures (5, 6, 61) to prevent overhead debris from entering the protection of the mobile canopy (1). In one embodiment, the curtains (64) are heavy material having some slack in order to gather any debris that might fall from overhead. In another embodiment, the covered structure (5) that is positioned nearest the heading is covered by mesh sheets 1.3 m×4 m, lengthwise so there is some overlap between the two covered structures (5,6). The leading covered structure (61), i.e. the one positioned closest to the heading (3), may be provided so that the frame (11) and wall shielding (40) are more permanently connected to vertical supports (10). As described above, longitudinal supports (63) connecting the cross members (32) and the vertical supports (10) provide a more permanent and solid structure.

Although both covered structures (5,6) can have identical characteristics, it is preferred that at least the structure (6) farthest from the tunnel face be provided so that the shield (12) can be detached from the frame (11) and used in the ground support activities. In particular, the shield (12) is detached from the frame (11) and bolted to the roof of the drift (2). In this embodiment, the second covered structure (6) will comprise of standard mesh width-wise across the drift, so as to enable the normal installation of mesh and pattern reinforcement. Similarly the wall shielding (40) can be detached from the frame (11) and/or vertical supports (10) and used to support the walls of the drift (2). By providing detachable shielding on the second structure (6), the amount of time required to complete the ground support activities can be decreased.

Typically the covered structure (5 or 61) that is positioned closest to the heading (3) will have shielding that is meant to only be removed when damaged. However, it is contemplated that this structure might also have detachable shielding the can be used in ground support activities.

The present invention has been described with regard to preferred embodiments. However, it will be obvious to persons skilled in the art that a number of variations and modifications can be made without departing from the scope of the invention as described herein.

I claim:

1. A mobile canopy for use in a mining process, said mobile canopy comprising at least a first covered structure and a second covered structure, wherein the first and second covered structures each comprise a plurality of vertical supports connected to an inverted u-shaped frame and at least one of the covered structures supports a shield extending over the u-shaped frame comprising mesh coverage that can be detached from the u-shaped frame and moved away from the u-shaped frame toward a roof of a tunnel from inside the u-shaped frame to be attached to walls and the roof of the tunnel.

2. The mobile canopy of claim 1, further comprising a third covered structure comprising a plurality of vertical supports connected to a frame that supports a shield comprising mesh coverage that can be detached from the u-shaped frame and moved away from the u-shaped frame from inside the u-shaped frame to be attached to walls and a roof of the tunnel.

3. The mobile canopy of claim 2, wherein wheels are provided on one or more of the vertical supports to allow the mobile canopy to move within the tunnel.

4. The mobile canopy of claim 2, wherein one or more of the vertical supports engage wheels, or rails provided within the tunnel, to move the mobile canopy.

5. The mobile canopy of claim 2, wherein of the covered structures comprises longitudinal supports that interconnect adjacent cross-members of the frame and the shields of the other two covered structures comprise mesh coverage.

6. The mobile canopy of claim 2, wherein at least two of the covered structures are linked.

7. The mobile canopy of claim 2, wherein the covered structures further comprises one or more wall shieldings to shield against rock displacements from the walls and a face of the tunnel.

8. The mobile canopy of claim 7, wherein wall shielding of one of the covered structures comprises longitudinal supports that interconnect adjacent vertical supports and the wall shielding of the other two covered structures comprise mesh coverage.

9. The mobile canopy of claim 1, wherein one or more of the plurality of vertical supports are adjustable to lengthen the support.

10. The mobile canopy of claim 9, wherein the one or more of the plurality of vertical supports are provided with hydraulics or pneumatics to adjust the height of the support.

* * * * *